US007068251B2

(12) United States Patent
Lin et al.

(10) Patent No.: US 7,068,251 B2
(45) Date of Patent: Jun. 27, 2006

(54) PIXEL CIRCUIT FOR LIQUID CRYSTAL DISPLAY USING STATIC MEMORY

(75) Inventors: Jan-Ruei Lin, Hsinchu (TW); Bowen Wang, Hsinchu (TW); Shang-Li Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 375 days.

(21) Appl. No.: 10/632,911

(22) Filed: Aug. 4, 2003

(65) Prior Publication Data

US 2004/0189577 A1 Sep. 30, 2004

(30) Foreign Application Priority Data

Mar. 28, 2003 (TW) ..... 92107205 A

(51) Int. Cl.
*G09G 3/36* (2006.01)

(52) U.S. Cl. ..... 345/87; 345/92; 349/42

(58) Field of Classification Search ..... 2/73, 2/78.1–78.4, 400–403, 406, 238, 227, 228, 2/105, 106, 69, 243.1, 80, 83, 87–90, 93, 2/85, 51, 108, 115, 113, 49.1, 49.4, 275, DIG. 2, 2/92, 95, 98–100, 104, 204, 205; 349/41–43
See application file for complete search history.

(56) References Cited

U.S. PATENT DOCUMENTS

| | | | | |
|---|---|---|---|---|
| 6,005,558 | A * | 12/1999 | Hudson et al. | 345/204 |
| 6,333,737 | B1 * | 12/2001 | Nakajima | 345/205 |
| 6,731,306 | B1 * | 5/2004 | Booth et al. | 345/690 |
| 2001/0015715 | A1 * | 8/2001 | Hebiguchi et al. | 345/92 |
| 2001/0043177 | A1 * | 11/2001 | Huston et al. | 345/87 |
| 2005/0007352 | A1 * | 1/2005 | Nathan et al. | 345/204 |

* cited by examiner

*Primary Examiner*—Ricardo Osorio
*Assistant Examiner*—Mansour M. Said
(74) *Attorney, Agent, or Firm*—Bacon & Thomas, PLLC

(57) ABSTRACT

A Pixel Circuit For Liquid Crystal Display Using Static Memory is disclosed, wherein a digital circuit is installed at a pixel of the liquid crystal display (LCD) for processing static image. The digital circuit works with an analog circuit for processing dynamic image. Several multiplexers and static memory are provided to enhance the digital and analog signal processing, for lowering the power consumption so as to accomplish power saving function of a Pixel Circuit For Liquid Crystal Display Using Static Memory.

8 Claims, 6 Drawing Sheets

PIXEL CIRCUIT FOR LIQUID CRYSTAL DISPLAY USING STATIC MEMORY

BACKGROUND OF THE INVENTION

1. Field of the Invention

The invention is related to a Pixel Circuit For Liquid Crystal Display Using Static Memory, wherein a digital circuit is installed at a pixel of the liquid crystal display for processing static image. The digital circuit works with an analog circuit for lowering the power consumption so as to accomplish power saving function of a Pixel Circuit For Liquid Crystal Display Using Static Memory.

2. Description of the Prior Art

Liquid crystal display (LCD) is widely used in notebook computers and various apparatus with display functions. An image pixel driving circuit used in the LCD is an analog circuit. Among prior art LCD elements, passive or active matrix liquid crystals such as thin film transistor (TFT) and twisted nematic (TN) are used. A schematic view of exemplary circuit of a prior art pixel circuit is shown in the FIG. 1. The circuit shown in the FIG. 1 is used as a basic unit to form a LCD. All unit circuits share a scanning line 103 and data line 105. FIG. 1 shows a circuit of active matrix TFT LCD 101. The architecture of image pixel is composed of TFT LCD 101, a capacitor 107 a liquid crystal unit 109. An analog voltage is required to write into the capacitor 107 so as to display gray level image, and a scanning line 103 as the circuit switch. When a signal from scanning line 103 indicates to switch the liquid crystal unit on, the data line 105 then charges/discharges the capacitor 107. Due to the malfunction of TFT 101, a current leakage may occur and result in gray level loss. To prevent aforementioned phenomenon and render a good gray level display, the data line 105 is required to continually charge/discharge TFT 101. Said operation results in a refresh rate data, which serves as an important reference for LCD performance.

In the prior art, a surface stabilized ferroelectric liquid crystal (SSFLC) is also used to form a LCD. The SSFLC has spontaneous polarization. When an external electric field is applied, the direction of the spontaneous polarization reverses and such direction is then retained. As a result, when the LCD displays static image, it's no longer required to continually writing signals into pixels, neither is required to continually charge/discharge data line, so as to reduce power consumption. The drawback of the method is that such display only shows black and white. A gray level display requires complicated circuits such as pulse width modulation (PWM).

In order to resolve the aforementioned drawbacks of Pixel Circuit For Liquid Crystal Display Using Static Memory such as high power consumption or requirements to use complicated circuits, a digital circuit is employed at a pixel of the LCD in the present invention, such frequent display refresh is eliminated and the power consumption is reduced.

SUMMARY OF THE INVENTION

The invention is about a Pixel Circuit For Liquid Crystal Display Using Static Memory. A digital circuit is installed at a pixel of the liquid crystal display for processing static image. The digital circuit works with an analog circuit for processing dynamic image. Traditionally, analog pixels have better performance for gray level display. According to the present invention, a digital operation is provided, wherein the data line is not required to be charged/discharged, such that the power consumption is reduced. In addition, several multiplexers are provided to enhance the digital and analog signal processing, for lowering the power consumption so as to accomplish power saving function of a Pixel Circuit For Liquid Crystal Display Using Static Memory.

The Pixel Circuit For Liquid Crystal Display Using Static Memory comprises a plurality of multiplexers, acting as switching elements for performing a plurality of output voltage transforming functions; a static memory, connecting to a scanning line, a thin film transistor and a capacitor, for storing the digital voltage signals stored in the capacitor; a thin film transistor, for connecting a scanning line and a data line, acting as a control switch of the circuit; and a capacitor, connecting to the thin film transistor, where analog or digital signals from the data line are stored.

The invention can be more fully understood by reading the following detailed description of the preferred embodiments, with reference made to the accompanying drawings.

DETAILED DESCRIPTION OF THE PREFERRED EMBODIMENTS

The present invention initializes a digital operation mode of static memory (SRAM) to enable a static image display without continually refreshing the display, so as to reduce power consumption and save power.

Figure 1:
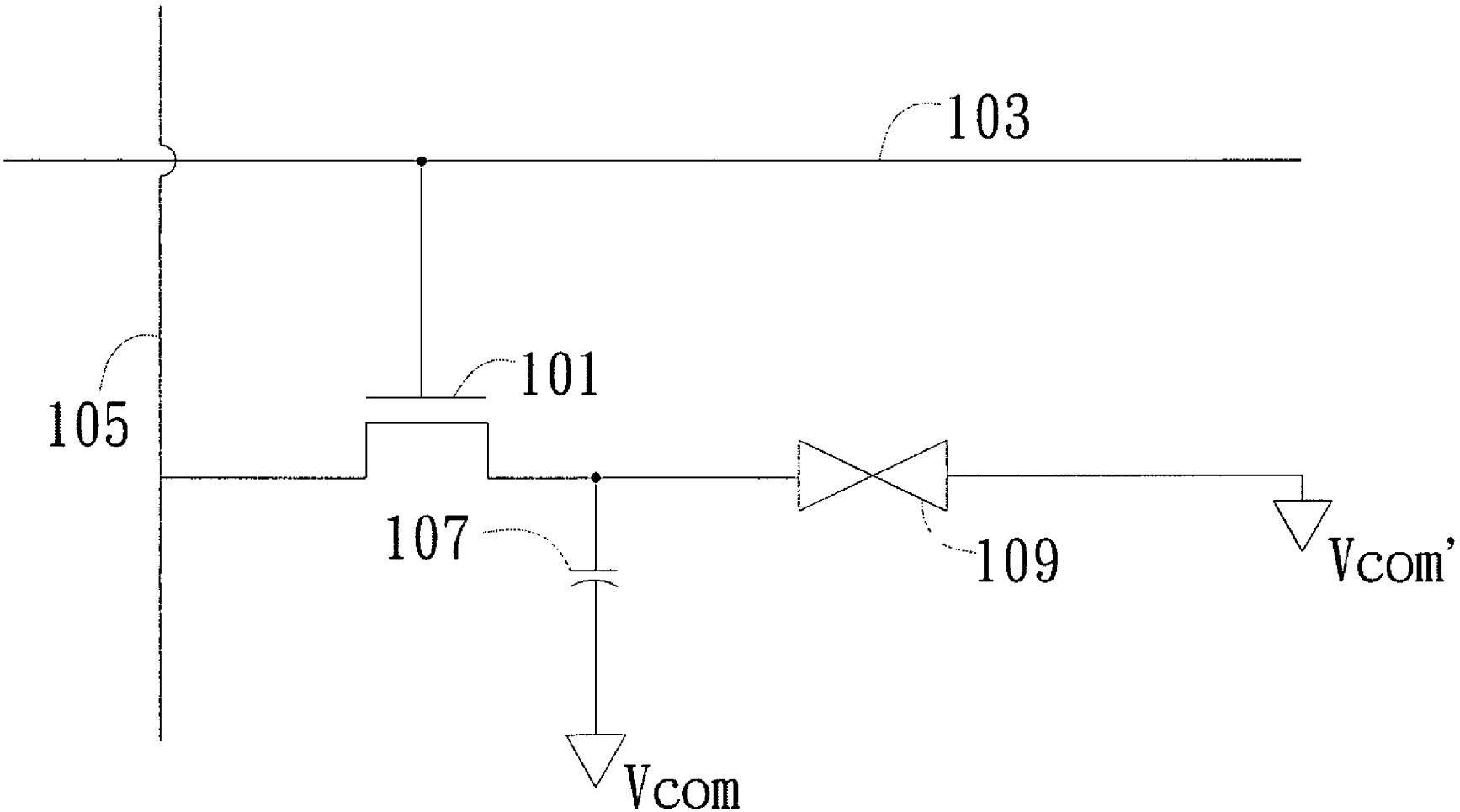
FIG. 1 (prior art)
FIG. 1 is a schematic view showing a prior art pixel circuit.
Figure 2A:
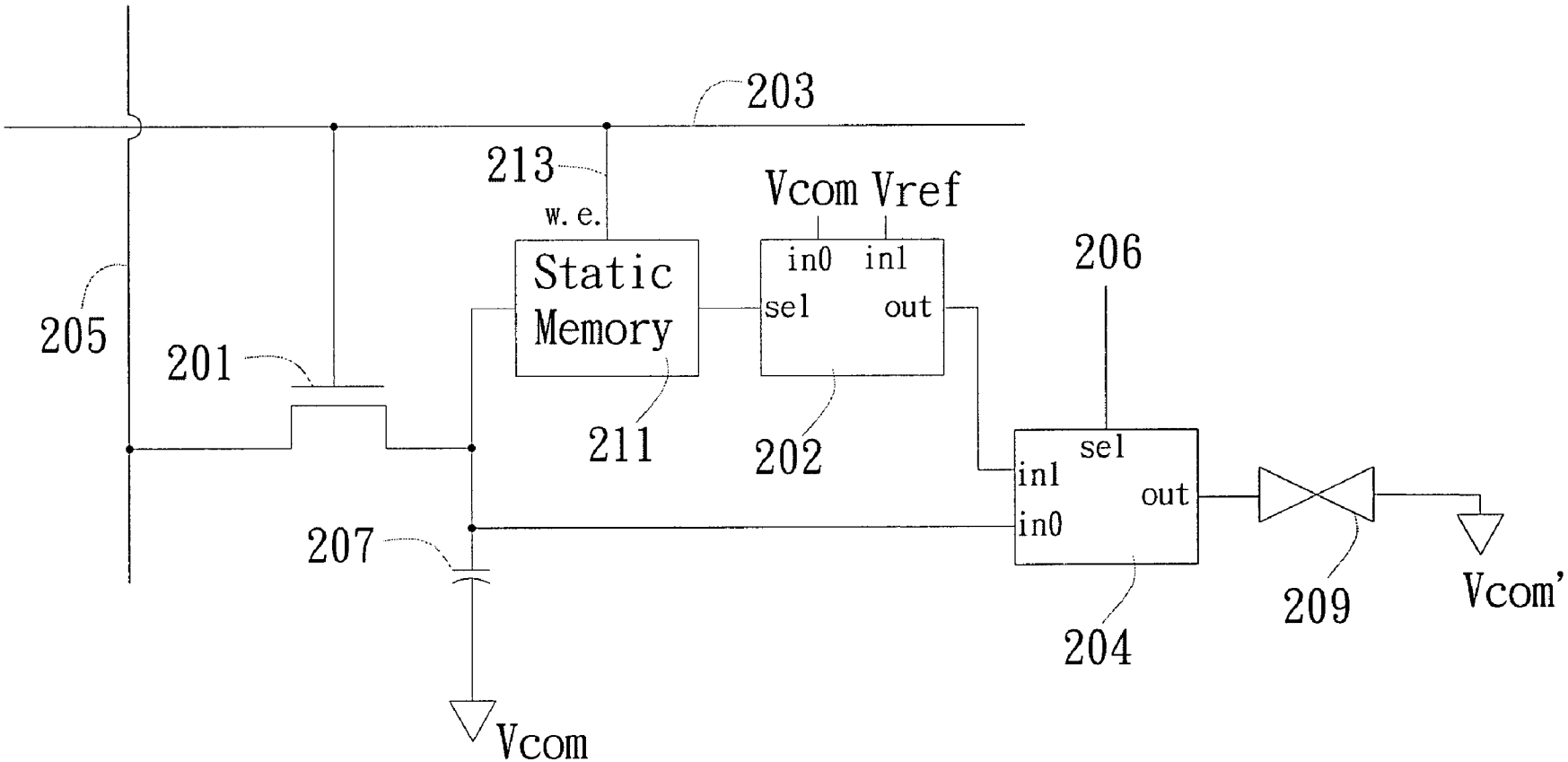
FIG. 2A is a block diagram showing a static random access memory pixel circuit according to the Pixel Circuit For Liquid Crystal Display Using Static Memory in the third embodiment of the present invention.

Refer to FIG. 2A, which is a block diagram showing a static random access memory pixel circuit according to the Pixel Circuit For Liquid Crystal Display Using Static Memory in the third embodiment of the present invention. After the write enable function of SRAM 211 is initiated by the scanning line 203, digital voltage values from the data line 205 are stored to the capacitor 207 via TFT 201. The voltage value stored in the capacitor 207 is also simultaneously written onto SRAM 211, and output from general voltage terminal Vcom or reference voltage terminal Vref depending on which is selected by the multiplexer 202. Then the mode control terminal 206 controls the second multiplexer 204, for determining whether to operate on the digital mode, where Vcom or Vref from the first multiplexer 202 is used to apply a bias on liquid crystal unit 209, or operate in the analog mode, where the analog voltage image value stored in the capacitor 207 is used to apply a bias on liquid crystal unit 209. If the mode control terminal receives control signals for a dynamic or static image, the operation is on the first mode. The analog mode control signals are input into the second multiplexer 204 via selection terminal se1, the first mode terminal in0 may connect to the capacitor 207 or connect scanning line 203 and data line 205 via TFT 201. When the scanning line 203 switches on the TFT 201, an analog image voltage value from the data line 205 is written to the capacitor 107 via the TFT 201. Then the analog image voltage value is connected to the liquid crystal unit 109 via the output terminal out of the second multiplexer 204. When the operation is in the analog mode circuit for dynamic image display, such analog value and the bias of general voltage terminal Vcom from both ends of liquid crystal unit 209, form the gray level display.

If the mode control terminal 206 receives digital mode control signals for a static image, it indicates that the operation is on the second mode according to the present invention, the digital mode control signals are input into second multiplexer 204 via selection terminal sel, then connected to the first multiplexer 202 via the second mode terminal in1. On the other hand, after the scanning line 203 initiates the write enable function of TFT 201 and SRAM 211, the data line 205 writes the digital voltage signals into the capacitor 207 via the TFT 201. the digital voltage values stored in the SRAM 211 are used for determining whether the operation should switch to general voltage terminal Vcom or reference voltage terminal Vref in the first multiplexer 202. Also, stored digital voltage value in the SRAM 211 is updated until the scanning line 203 initiates the data write enable function of the SRAM 211 again. As a result, the data line 205 is not required to charge/discharge capacitor 207. The first multiplexer 202 can directly retrieve the digital voltage signals stored in the SRAM 211, then the first multiplexer determines to operate via the general voltage terminal Vcom or the reference voltage terminal Vref, and applies a bias to the liquid crystal unit 209 via second multiplexer 204 to accomplish a bright/dim display. The worries about current leakage of TFT 201 or capacitor 207 and the resulting digital voltage level loss are therefore waived. Such application does not only reduce the power consumption, also it is made possible to change the bias status of the liquid crystal unit 209 via the general voltage terminal Vcom and the reference voltage terminal Vref.

Figure 2B:
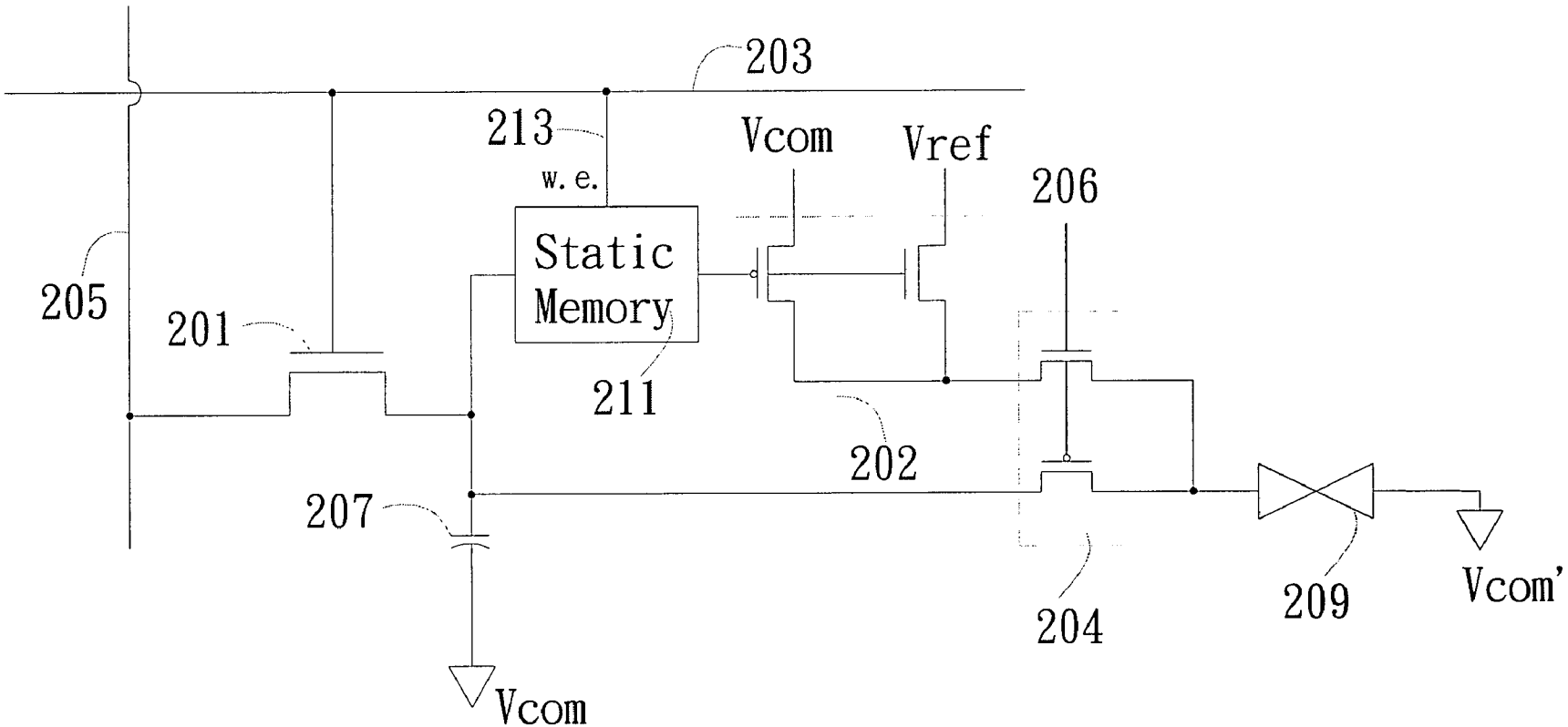
FIG. 2B is a schematic diagram showing a static random access memory pixel circuit according to the Pixel Circuit For Liquid Crystal Display Using Static Memory in the third embodiment of the present invention.

FIG. 2B is a schematic diagram showing a static random access memory pixel circuit according to the Pixel Circuit For Liquid Crystal Display Using Static Memory in the third embodiment of the present invention. According to the diagram, the second multiplexer 204 is used for switching between the first mode (analog mode) and the second mode (digital mode) via using a plurality of transistors as switches. The first multiplexer 202 composed of a plurality of transistors is used for switching between the general voltage terminal Vcom and the reference voltage terminal Vref. Then digital control signals for voltage switching are stored in the SRAM 211. The SRAM 211 is a circuit loop composed of one or a plurality of switch transistors and inverters, for initiating data write enable function and storing the voltage signals.

Figure 2C:
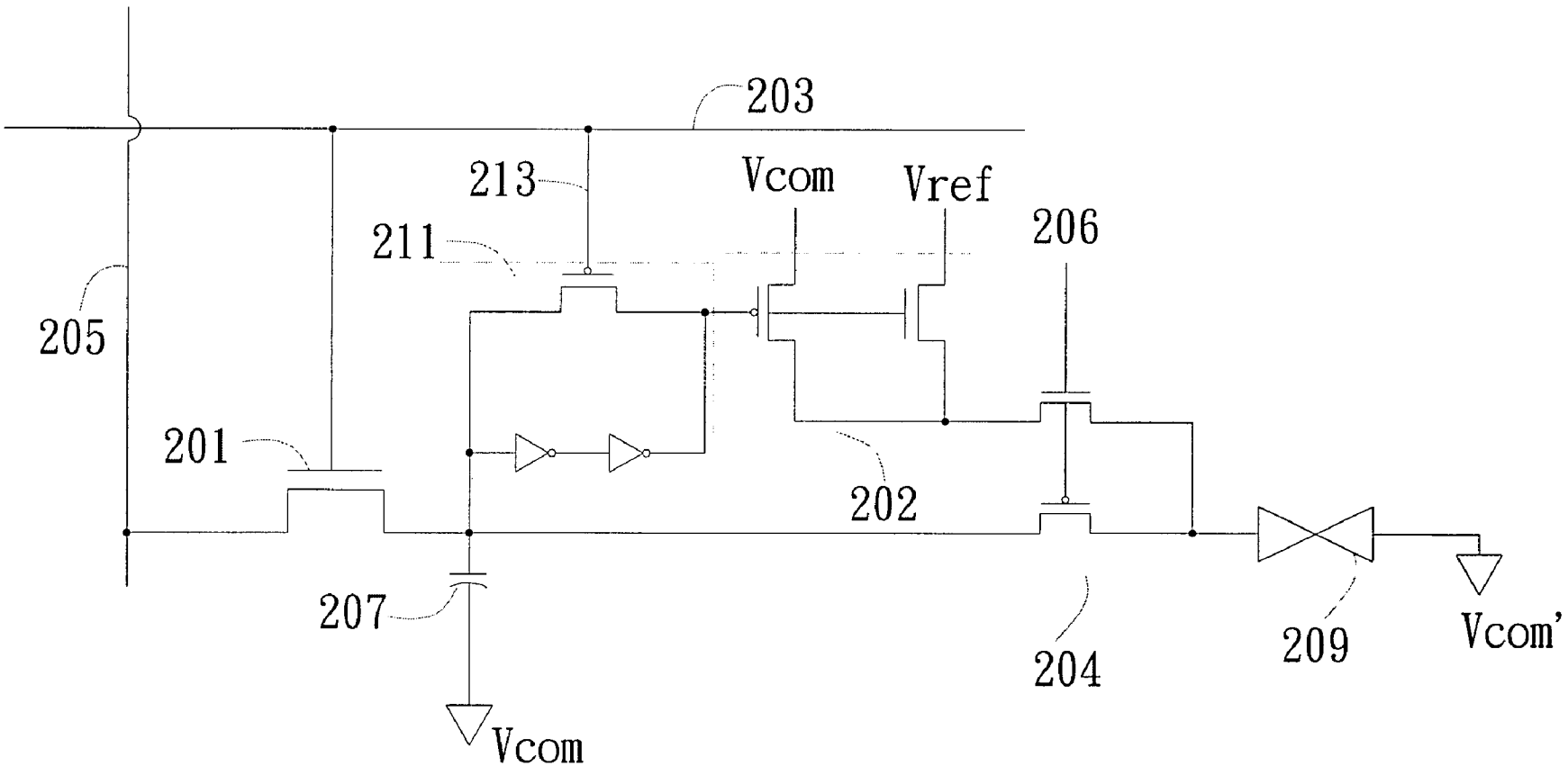
FIG. 2C is a schematic diagram showing a static random access memory pixel circuit according to the Pixel Circuit For Liquid Crystal Display Using Static Memory in the third embodiment of the present invention.

FIG. 2C describes the implementation of SRAM 211. When the scanning line 203 is required to write data into SRAM 211, the data write enable (w.e.) function has to be initiated first, such that the stored digital voltage value is updated. The SRAM 211 allows signals input from scanning line 203 at a write enable control terminal 401. The voltage values are memorized by delay circuit latch composed of a plurality of inverters.

Figure 3A:
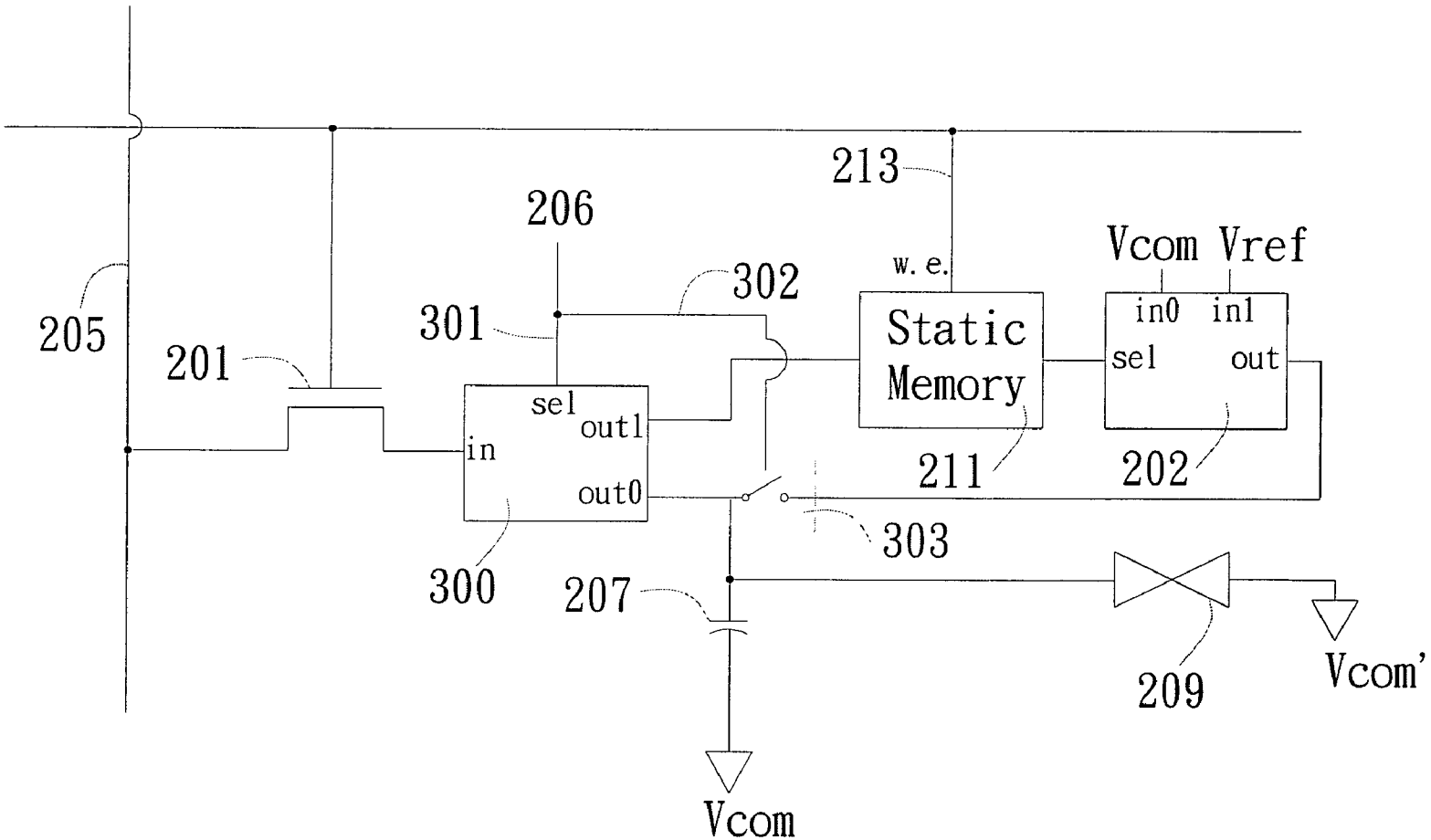
FIG. 3A is a block diagram showing a static random access memory pixel circuit according to the Pixel Circuit For Liquid Crystal Display Using Static Memory in the fourth embodiment of the present invention.

FIG. 3A is a block diagram showing a static random access memory pixel circuit according to the Pixel Circuit For Liquid Crystal Display Using Static Memory in the fourth embodiment of the present invention. As shown in the diagram, such Pixel Circuit For Liquid Crystal Display Using Static Memory comprises a demultiplexer 300 composed of a plurality of transistors, a SRAM 211, a first multiplexer 202 and a second switch device 303. The first multiplexer 202 and the demultiplexer 300 are switch elements used for switching signal input source. When the signals from the scanning line 203 switches on the liquid crystal circuit, on signals are input to the TFT 201, through the TFT 201, analog voltage signals from data line 205 are input into the demultiplexer 300 at the input terminal of the demultiplexer 300. The demultiplexer 300 composed of a plurality of transistors is a device having a plurality of switch functions. If the mode control terminal 206 receives analog control signals for a dynamic or static image, the operation is on the first mode. The control signals are input into the demultiplexer 300 at the selection terminal of the demultiplexer 300 via a first signal line 301. The signals for the first mode are input to second switch device 303 via second signal line 302. The second switch device 303 isolates the digital circuit from the analog circuit. The control signal of the first mode is an analog control signal. The analog control signal is input into demultiplexer 300 at the input terminal via the TFT 201. The analog voltage signal from the data line 205 connected is output at the first mode output terminal out0. Since the control signal for the first mode via the second signal line 302 is an off signal to the second switch device 303, the analog voltage value is output at the first mode output terminal out0 and then directly input to the capacitor 207 for applying a bias on liquid crystal unit 209 so as to display a gray level image. The circuit under the analog mode uses the second switch device for isolating the SRAM 211 and the first multiplexer 202, so as to prevent the function of digital circuit and the switching of multiplexers from affected by the analog voltage when the operation is on the analog circuit mode for dynamic image display.

In addition, when the signals from the scanning line 203 switches on the liquid crystal circuit, the on signal is input to the TFT 201 and write enable control terminal 401 of the SRAM 211. Through the TFT 201, the digital voltage sig0nal from data line 205 is input into the demultiplexer 300 at the input terminal in of the demultiplexer 300. If the mode control terminal 206 receives the digital mode control signal for a static image, the operation is on the second mode. The control signal from the first signal line 301 is input into a demultiplexer 200 at the selection terminal sel. In addition, the control signal of the second mode is input to the second switch device 303 via second signal line 302. The control signal of the second mode is a digital control signal. The digital control signal is input into demultiplexer 300 at the input terminal via the TFT 201. The digital voltage signal from the data line 205 connected is output at the second mode output terminal out1 to the SRAM 211. The digital value stored in the SRAM 211 is used for determining whether the output terminal out of the first multiplexer 202 should be the general voltage terminal Vcom or the reference voltage terminal Vref. When the second switch device 303 receives the control signal for second mode from the second signal line 302 of the mode control terminal 206 and is switched on, then the capacitor 207 connects to the output terminal out of the first multiplexer 202 and the bright/dim display status of the liquid crystal unit 209 is determined based on the voltage difference between two terminals of the capacitor 207. One terminal of the liquid crystal unit 209 is the general voltage terminal Vcom', and the voltage of the other terminal is the voltage of the general voltage terminal Vcom or the reference voltage terminal Vref. Due to the application of SRAM 211, the data line 205 is not required to charge/discharge capacitor 207. The stored digital voltage value in the SRAM 211 is updated until the scanning line 203 initiates the data write enable function of the SRAM 211 again.

Figure 3B:
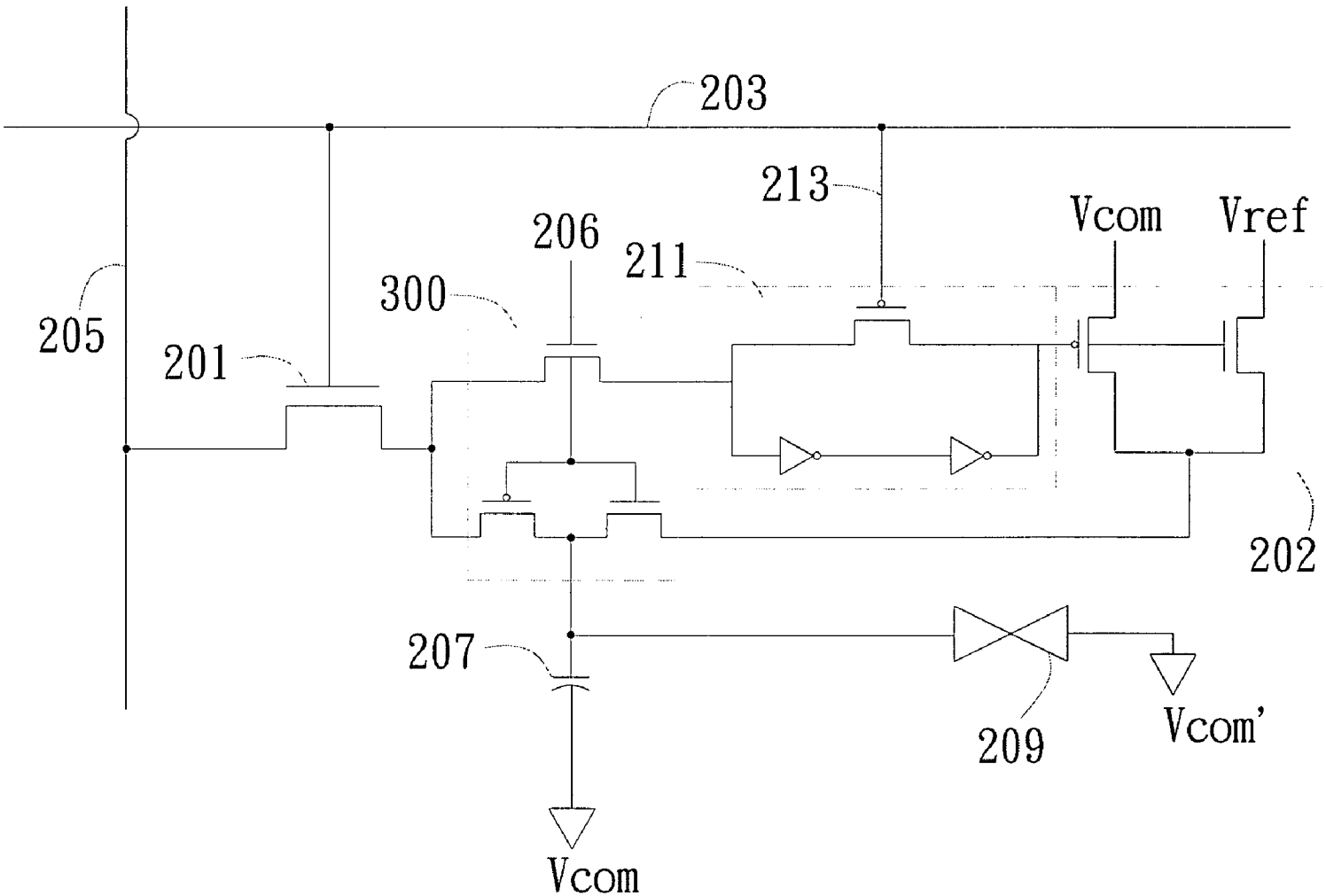
FIG. 3B is a schematic diagram showing a static random access memory pixel circuit according to the Pixel Circuit For Liquid Crystal Display Using Static Memory in the fourth embodiment of the present invention.

The schematic diagram in the FIG. 3B illustrates an implementation of an embodiment according to the block diagram shown in the FIG. 3A. The first multiplexer 202 is composed of plurality of transistors acting as switches for switching between the general voltage terminal Vcom and the reference voltage terminal Vref so as to determining the bright/dim display status of liquid crystal unit 209. The demultiplexer 300 composed of a plurality of transistors is a device having a plurality of switch functions. The SRAM 211 allows signals input from scanning line 203 at a write enable control terminal 401. The delay circuit latch composed of a plurality of inverters memorizes the voltage value, as a reference data to mode switching of the first multiplexer 202 and the demultiplexer 300.

The above provides a detailed description of the embodiments according to the Pixel Circuit For Liquid Crystal Display Using Static Memory in the present invention. The present invention lowers the refresh rate of the display and the power consumption by implementing a plurality of multiplexers and analog and digital pixel circuits for liquid crystal display composed of DRAM or SRAM.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

The invention claimed is:

1. A pixel circuit for a liquid crystal display using a static memory for lowering power consumption by combining an analog and a digital circuit, wherein the circuit comprises:

a first multiplexer, having a plurality of current switching elements;

a demultiplexer, having a plurality of current switching elements;

a static memory, connecting to a scanning line connected to the first multiplexer and the demultiplexer, for storing the digital voltage signals stored in the demultiplexer;

a thin film transistor, for connecting a scanning line and a data line, acting as a control switch of the circuit;

a capacitor, connected to the thin film transistor, where analog or digital signals from the data line are stored; and a switch device, connected to the first multiplexer, the demultiplexer and a liquid crystal unit.

2. The pixel circuit for a liquid crystal display using a static memory of claim 1, wherein said first multiplexer further comprises a general voltage terminal and a reference voltage terminal.

3. The pixel circuit for a liquid crystal display using a static memory of claim 1, wherein the switch device connects to a mode terminal via a second signal line for controlling switch signals.

4. The pixel circuit for a liquid crystal display using a static memory of claim 1, wherein the demultiplexer further comprises:

a selection terminal;

a demultiplexer input terminal;

a first mode terminal; and a second mode terminal.

5. The pixel circuit for a liquid crystal display using a static memory of claim 4, wherein said demultiplexer further connects to a mode terminal.

6. The pixel circuit for a liquid crystal display using a static memory of claim 4, wherein the input terminal of the demultiplexer further connects to the thin film transistor.

7. The pixel circuit for a liquid crystal display using a static memory of claim 4, wherein the output terminal of the first mode terminal further connects to the switch device.

8. The pixel circuit for a liquid crystal display using a static memory of claim 4, wherein the output terminal of the second mode terminal further connects to the static memory.

* * * * *